US010267566B2

(12) United States Patent
Ishikawa et al.

(10) Patent No.: US 10,267,566 B2
(45) Date of Patent: Apr. 23, 2019

(54) HEAT EXCHANGER

(71) Applicant: FUTABA INDUSTRIAL CO., LTD., Okazaki-shi, Aichi (JP)

(72) Inventors: Hiromi Ishikawa, Okazaki (JP); Hirohisa Okami, Okazaki (JP)

(73) Assignee: FUTABA INDUSTRIAL CO., LTD., Okazaki-shi, Aichi (JP)

( * ) Notice: Subject to any disclaimer, the term of this patent is extended or adjusted under 35 U.S.C. 154(b) by 0 days.

(21) Appl. No.: 15/535,772

(22) PCT Filed: Dec. 4, 2015

(86) PCT No.: PCT/JP2015/084173
§ 371 (c)(1),
(2) Date: Jun. 14, 2017

(87) PCT Pub. No.: WO2016/098617
PCT Pub. Date: Jun. 23, 2016

(65) Prior Publication Data

US 2017/0343291 A1 Nov. 30, 2017

(30) Foreign Application Priority Data

Dec. 15, 2014 (JP) ..... 2014-253377

(51) Int. Cl.
*F28D 9/00* (2006.01)
*F28F 3/02* (2006.01)
(Continued)

(52) U.S. Cl.
CPC ..... *F28D 9/0012* (2013.01); *F02M 26/32* (2016.02); *F28D 9/0043* (2013.01);
(Continued)

(58) Field of Classification Search
CPC .... F28D 9/0012; F28D 21/0003; F28D 7/005; F28D 7/024; F28D 9/0043; F28F 3/025;
(Continued)

(56) References Cited

U.S. PATENT DOCUMENTS 3,424,240 A * 1/1969 Stein ..... F02C 7/08 165/166
3,473,604 A * 10/1969 Tiefenbacher ..... F28D 9/00 165/166
(Continued)

FOREIGN PATENT DOCUMENTS

CN 201100835 Y 8/2008
CN 201954991 U 8/2011
(Continued)

OTHER PUBLICATIONS

Notification of Transmittal of Translation of IPRP (Form PCT/IB/338), International Preliminary Report on Patentability (Chapter I of the Patent Cooperation Treaty) (Form PCT/IB/373) and Translation of Written Opinion of the International Search Authority (Form PCT/ISA/237) for International Patent Application No. PCT/JP2015/084173, dated Jun. 29, 2017 (11 pages).
(Continued)

*Primary Examiner* — Justin M Jonaitis
(74) *Attorney, Agent, or Firm* — Withrow & Terranova, P.L.L.C.; Vincent K. Gustafson

(57) ABSTRACT

A heat exchanger in one aspect of the present disclosure comprises a plurality of plate parts. The plurality of plate parts is arranged such that respective outer surfaces of mutually-adjacent plate parts of the plurality of plate parts are in a non-contact state having a gap between the respective outer surfaces, and apexes, each of which is an apex of the at least one convex protruding from each of respective mutually-facing outer surfaces of the mutually-adjacent
(Continued)

plate parts, do not face each other in an arrangement direction of the plurality of plate parts.

8 Claims, 4 Drawing Sheets

(51) Int. Cl.
*F02M 26/22* (2016.01)
*F02M 26/32* (2016.01)
*F28D 21/00* (2006.01)
*F28F 27/02* (2006.01)

(52) U.S. Cl.
CPC ..... *F28D 21/0003* (2013.01); *F28F 3/025* (2013.01); *F28F 27/02* (2013.01); *F02M 26/22* (2016.02)

(58) Field of Classification Search
CPC ..... F28F 9/0265; F28F 2250/00; F01N 5/02; F01N 2240/02; F01N 2240/36; Y02T 10/16; B60H 1/025
USPC ..... 165/177, 41, 165, 166, 167
See application file for complete search history.

(56) References Cited

U.S. PATENT DOCUMENTS 4,133,377 A * 1/1979 de Lallee ..... B01D 1/065 165/118
4,272,462 A * 6/1981 Butt ..... F28D 5/02 165/166
4,293,033 A * 10/1981 Nasser ..... F28D 9/0031 165/166
5,806,584 A * 9/1998 Thonon ..... F28F 3/046 165/166
6,047,769 A 4/2000 Shimoya et al.
7,036,568 B2 * 5/2006 Yamauchi ..... F28D 1/0316 165/148
8,272,430 B2 * 9/2012 Yamada ..... F28D 9/005 165/109.1
2010/0243220 A1 * 9/2010 Geskes ..... F02B 29/0418 165/133
2015/0184571 A1 7/2015 Kobayashi et al.

FOREIGN PATENT DOCUMENTS

CN 102395853 A 3/2012
JP S55-001125 U 1/1980
JP S57-207787 A 12/1982
JP 4122578 B2 7/2008
WO 2014-014080 A1 1/2014

OTHER PUBLICATIONS

International Search Report for International Patent Application No. PCT/JP2015/084173 (Form PCT/ISA/210), dated Feb. 23, 2016 (4 pages including English translation).
Written Opinion for International Patent Application No. PCT/JP2015/084173 (Form PCT/ISA/237), dated Feb. 23, 2016 (10 pages including English machine translation).
Notification of the First Office Action for Chinese Patent Application No. 201580068381.X, dated Jun. 22, 2018, 11 pages.
Notification of Reasons for Refusal for Japanese Patent Application No. 2014-253377, dated Sep. 4, 2018, 9 pages.
Decision of Refusal for Japanese Patent Application No. 2014-253377, dated Feb. 12, 2019, 7 pages.
The Second Office Action for Chinese Patent Application No. 20158006381.X, dated Feb. 19, 2019, 13 pages.

* cited by examiner

HEAT EXCHANGER

CROSS-REFERENCE TO RELATED APPLICATIONS

This application is a 35 U.S.C. § 371 phase filing of International Application No. PCT/JP2015/084173 filed on Dec. 4, 2015, and claims the benefit of Japanese Patent Application No. 2014-253377 filed on Dec. 15, 2014 with the Japan Patent Office. The entire disclosures of International Application No. PCT/JP2015/084173 and Japanese Patent Application No. 2014-253377 are hereby incorporated by reference herein in their respective entireties.

TECHNICAL FIELD

The present disclosure relates to a heat exchanger.

BACKGROUND ART

A stacked-plate heat exchanger that comprises a plurality of rectangular plates through which a first fluid flows and that exchanges heat between a second fluid flowing around the outside of the plurality of plates and the first fluid has been known (see, Patent Document 1 below). In the plates of the heat exchanger described in Patent Document 1, each of the plates has a plurality of pressed-out portions formed by pressing out surfaces of the plates outwardly in a protruding manner so as to form convexes. Each of the pressed-out portions is formed such that a longitudinal direction of the pressed-out portion is along a diagonal line of the plate.

The plate of the heat exchanger described in Patent Document 1 is arranged such that a long side of the plate is orthogonal to a flow direction of the second fluid; the plates are fixed such that respective protruding surfaces of the pressed-out portions abut each other on a flow path of the second fluid. With this configuration, the pressed-out portions, the protruding surfaces of which abut each other, function as a turbulent flow generator for creating a turbulence by inhibiting a linear flow of the second fluid.

Consequently, the heat exchanger described in Patent Document 1 can increase heat transfer efficiency on an outer surface of the plate, thereby improving heat exchange efficiency.

PRIOR ART DOCUMENTS

Patent Documents

Patent Document 1: Japanese Patent No. 4122578

SUMMARY OF THE INVENTION

Problems to be Solved by the Invention

Heat exchangers have been desired to improve heat exchange efficiency.

For this purpose, the heat exchange efficiency obtained by the heat exchanger described in Patent Document 1, however, may not be sufficient.

In view of the foregoing, it is desirable in one aspect of the present disclosure to provide a heat exchanger having a further improved heat-exchange efficiency.

Means for Solving the Problems

One aspect of the present disclosure relates to a heat exchanger comprising a plurality of plate parts that comprises a flow channel through which a first fluid flows. Each of the plurality of plate parts comprises a corrugated part, at least an outer surface of which has a corrugated shape. This corrugated part comprises at least one convex protruding in a linear ridge-like manner outwardly from the outer surface at a specified distance.

Each of the plurality of plate parts is arranged such that a longitudinal direction of the at least one convex is a direction orthogonal to a flow direction of a second fluid. Also, the plurality of plate parts is arranged such that respective outer surfaces of mutually-adjacent plate parts of the plurality of plate parts are in a non-contact state having a gap between the respective outer surfaces, and apexes, each of which is an apex of the at least one convex protruding from each of respective mutually-facing outer surfaces of the mutually-adjacent plate parts, do not face each other in an arrangement direction of the plurality of plate parts.

Because the plate parts of the heat exchanger in one aspect of the present disclosure are arranged in the non-contact state, the gap is formed between the respective outer surfaces of the mutually-adjacent plate parts. In addition, the respective apexes of the concaves protruding from the mutually-facing outer surfaces of the mutually-adjacent plate parts are arranged so as not to face each other in the arrangement direction of the plate parts; thus, the gap formed between the plate parts is a corrugated gap.

The second fluid flows through the corrugated gap in a direction orthogonal to the longitudinal directions of the convexes of the plate parts. For this reason, part of the second fluid flowing through this gap hits the convexes of the plate parts. Accordingly, the heat exchanger in one aspect of the present disclosure can inhibit formation of a boundary layer around the convexes of the plate parts, to which the part of the second fluid hits, thereby increasing heat transfer efficiency between the outer surfaces of the plate parts and the second fluid.

Moreover, in the heat exchanger in one aspect of the present disclosure, the corrugated gap formed between the plate parts serves as a flow path for the second fluid. Therefore, blocking of a flow of the second fluid can be inhibited as much as possible, and occurrence of decrease in a flow rate of the second fluid can be reduced.

Furthermore, in the heat exchanger in one aspect of the present disclosure, the outer surface of the plate part has a corrugated shape. For this reason, with the heat exchanger in one aspect of the present disclosure, a surface area of the plate part to be in contact with the second fluid can be increased.

In view of the aforesaid, the heat exchanger in one aspect of the present disclosure can further improve heat exchange efficiency.

Moreover, the corrugated part in one aspect of the present disclosure may comprise at least one concave, and an inner surface may have a corrugated shape. "Concave" used herein is a section protruding inwardly in a linear ridge-like manner from the inner surface such that the section is adjacent to the at least one convex and that the outer surface is depressed from the at least one convex.

The plurality of plate parts may be configured such that the inner surfaces that face each other are in a non-contact state having a gap between the inner surfaces, and that a longitudinal direction of the at least one concave is a direction along a flow direction of the first fluid.

In the heat exchanger configured as described above, not only the outer surfaces of the plurality of plate parts, but also the inner surfaces of the plurality of plate parts, have a corrugated shape. For this reason, with the heat exchanger in one aspect of the present disclosure, a surface area of the plate part to be in contact with the first fluid can be increased.

Moreover, in the heat exchanger in one aspect of the present disclosure, the first fluid inside the plate part flows along a longitudinal direction of the corrugated shape of the inner surface of the plate part. Thus, with the heat exchanger in one aspect of the present disclosure, resistance to the flow of the first fluid, that is, pressure loss, can be reduced as much as possible.

As a result of the above-described configurations, the heat exchanger in one aspect of the present disclosure can improve the heat exchange efficiency.

Moreover, in one aspect of the present disclosure, each of the plurality of plate parts may have a tubular shape. In this case, the plurality of plate parts may be arranged along an axial direction. Specifically, the heat exchanger in one aspect of the present disclosure may be configured as a heat exchanger in which tubular plate parts are stacked in the axial direction, i.e., configured as a stacked-plate and tubular heat exchanger.

In the heat exchanger configured as described above, the flow direction of the second fluid can be made to be a direction in a radial direction and also, the flow direction of the first fluid can be made to be a direction in a circumferential direction of the plate part. For this reason, with the heat exchanger in one aspect of the present disclosure, the flow direction of the second fluid can be made to be a direction orthogonal to the flow direction of the first fluid. Also, in the heat exchanger in one aspect of the present disclosure, because the heat exchanger has a tubular shape, the flow direction of the second fluid that is made to be the direction orthogonal to the flow direction of the first fluid can be achieved across the entire plate part in the radial direction.

EXPLANATION OF REFERENCE NUMERALS

1 . . . exhaust-gas heat recovery device, 2 . . . exhaust part, 4 . . . shell member, 6 . . . heat exchange part, 8 . . . inflow part, 10 . . . valve, 12 . . . exhaust pipe, 14 . . . exhaust pipe, 16 . . . upstream end, 18 . . . exhaust downstream end, 20 . . . outer shell member, 22 . . . lid member, 24 . . . holding member, 28 . . . heat exchange chamber, 30 . . . heat exchanger, 32 . . . plate, 34 . . . inlet pipe, 36 . . . outlet pipe, 38 . . . body portion, 40 . . . first communication portion, 41 . . . second communication portion, 42 . . . first plate, 43 . . . wall part, 44 . . . first body section, 46 . . . first communication section, 48 . . . second communication section, 50 . . . first convex, 52 . . . first concave, 54 . . . first communication hole, 56 . . . second communication hole, 62 . . . second plate, 63 . . . wall part, 64 . . . second body section, 66 . . . third communication section, 68 . . . fourth communication section, 70 . . . second convex, 72 . . . second concave, 80 . . . gap, 82 . . . gap, 84 . . . gap, 88 . . . introduction member, 90 . . . tip section, 92 . . . straight pipe section, 94 . . . valve element, 96 . . . valve seat, 98 . . . valve shaft, 100 . . . mesh member, 140 . . . internal combustion engine, 142 . . . exhaust gas (second fluid), 144 . . . cooling fluid (first fluid)

MODE FOR CARRYING OUT THE INVENTION

Hereinafter, an embodiment as one example of the present disclosure will be described with reference to the drawings.

<Exhaust-Gas Heat Recovery Device>

Figure 1:
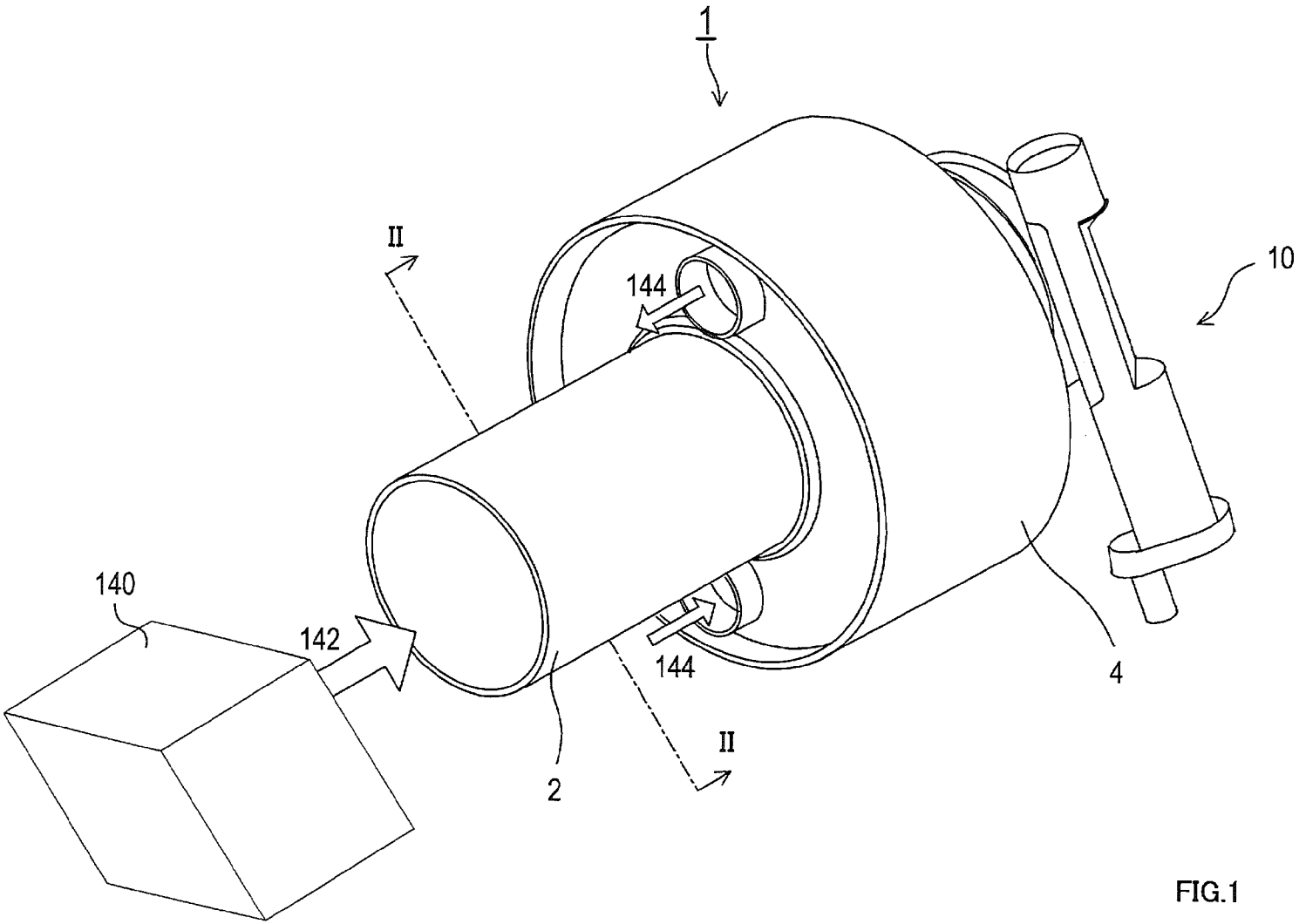
FIG. 1 is a perspective view showing an appearance of an exhaust-gas heat recovery device according to an embodiment.

An exhaust-gas heat recovery device 1 shown in FIG. 1 is installed in a moving body comprising an internal combustion engine 140. The exhaust-gas heat recovery device 1 exchanges heat between exhaust gas 142 from the internal combustion engine 140, which is a high temperature fluid, and a cooling fluid 144 of the internal combustion engine 140, which is a low temperature fluid, thereby recovering heat from the exhaust gas 142. In the present embodiment, the cooling fluid 144 may be cooling water or oil.

The exhaust gas 142 in the present embodiment corresponds to one example of a second fluid of the present disclosure, and the cooling fluid 144 in the present embodiment corresponds to one example of a first fluid of the present disclosure.

The exhaust-gas heat recovery device 1 of the present embodiment comprises an exhaust part 2, a shell member 4, a heat exchange part 6 (see FIG. 2), an inflow part 8 (see FIG. 2), and a valve 10.

The exhaust part 2 comprises a path for guiding the exhaust gas 142 from the internal combustion engine 140 to its downstream side. The shell member 4 is a member enclosing an outer side of the exhaust part 2. The heat exchange part 6 comprises a heat exchanger 30 (see FIG. 2) disposed between the exhaust part 2 and the shell member 4 so as to exchange heat between the exhaust gas 142 and the cooling fluid 144.

The inflow part 8 is a portion through which the exhaust gas 142 flows into the heat exchange part 6 from the exhaust part 2. The valve 10 is a valve for opening or closing a flow path of the exhaust gas 142 and is disposed downstream of the inflow part 8 in the flow path of the exhaust gas 142 in the exhaust part 2.

Figure 2:
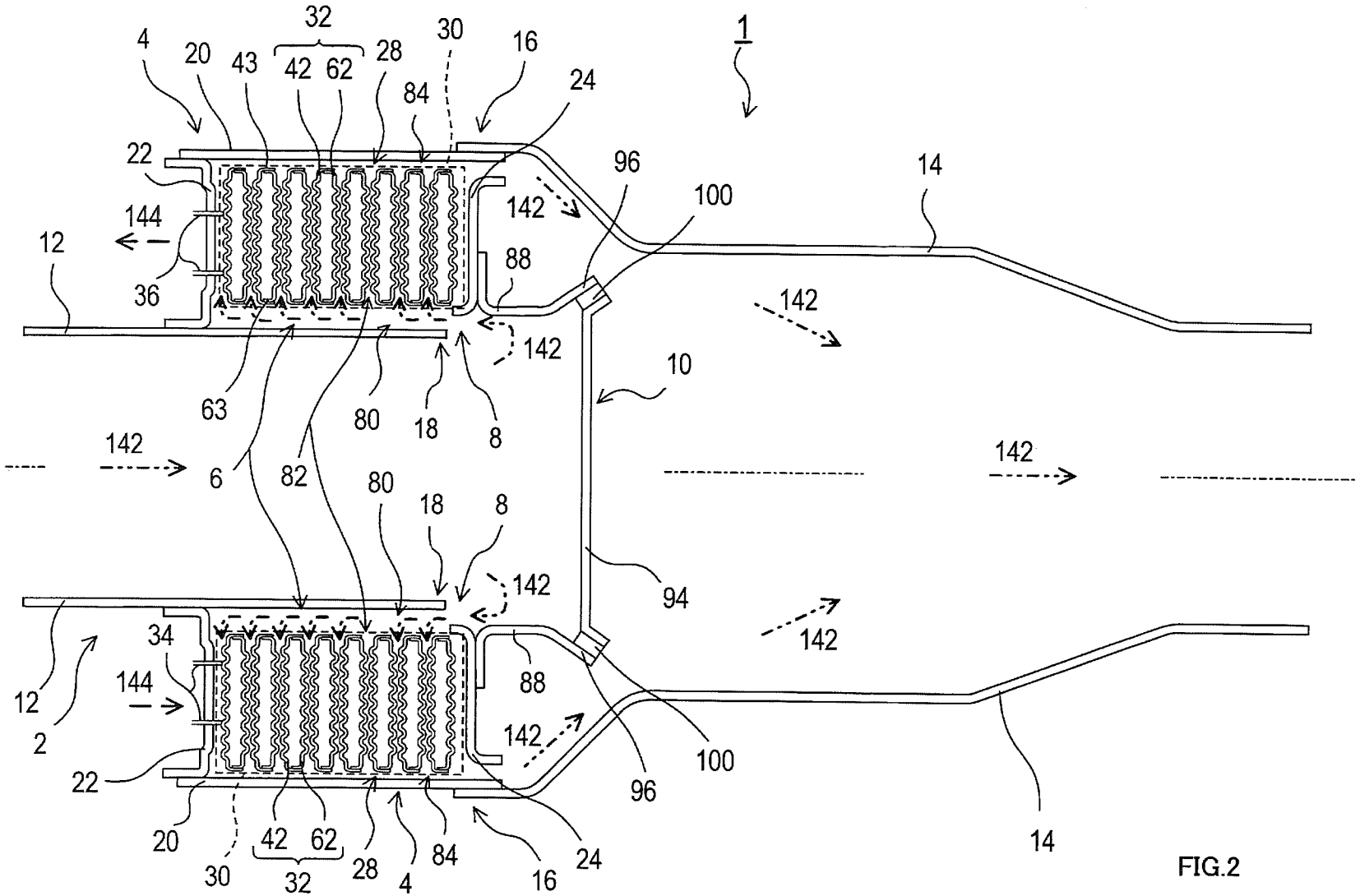
FIG. 2 is a sectional view of the exhaust-gas heat recovery device in a valve-closed state, taken along the line II-II in FIG. 1.

As shown in FIG. 2, the exhaust part 2 comprises an exhaust pipe 12. The exhaust pipe 12 is a cylindrical member having both ends being open. An upstream end of the exhaust pipe 12 is coupled to an exhaust pipe, an exhaust manifold, and so on, into which the exhaust gas 142 from the internal combustion engine 140 flows.

The shell member 4 comprises an exhaust pipe 14, an outer shell member 20, a lid member 22, and a holding member 24.

The exhaust pipe 14, as a whole, is a cylindrical member, one end of which is an upstream end 16 that has an opening with an inner diameter larger than an outer diameter of the exhaust pipe 12. In an inner space of the upstream end 16 of the exhaust pipe 14, an exhaust downstream end 18 of the exhaust pipe 12, which is an opposite end of the upstream end of the exhaust pipe 12, is disposed without being in contact with the shell member 4.

The outer shell member 20 is a cylindrical member having an inner diameter larger than the outer diameter of the exhaust pipe 12. A downstream end of the outer shell member 20 is coupled to the upstream end 16 of the exhaust pipe 14.

The lid member 22 closes an upstream-side opening of the outer shell member 20 in the flow path of the exhaust gas 142 in the exhaust pipe 12.

That is to say, a heat exchange chamber 28 is formed by the outer shell member 20, the lid member 22, and the exhaust pipe 12. The heat exchange chamber 28 is an annular space enclosed by the outer shell member 20, the lid member 22, and the exhaust pipe 12.

<Structure of Heat Exchanger>

The heat exchanger 30 disposed in the heat exchange chamber 28 comprises a plurality of plate parts 32-1 to 32-N, an inlet pipe 34, and an outlet pipe 36. That is, the heat exchanger 30 is a so-called stacked-plate heat exchanger. Here, the reference "N" is an identifier indicating the number of the plate parts 32 and is a positive integer of 2 or greater.

The inlet pipe 34 is a pipe through which the cooling fluid 144 from outside of the heat exchanger 30 flows into one of the plate parts 32. The outlet pipe 36 is a pipe through which the cooling fluid 144 flows out from the aforementioned one plate part 32 to the outside of the heat exchanger 30.

Figure 3:
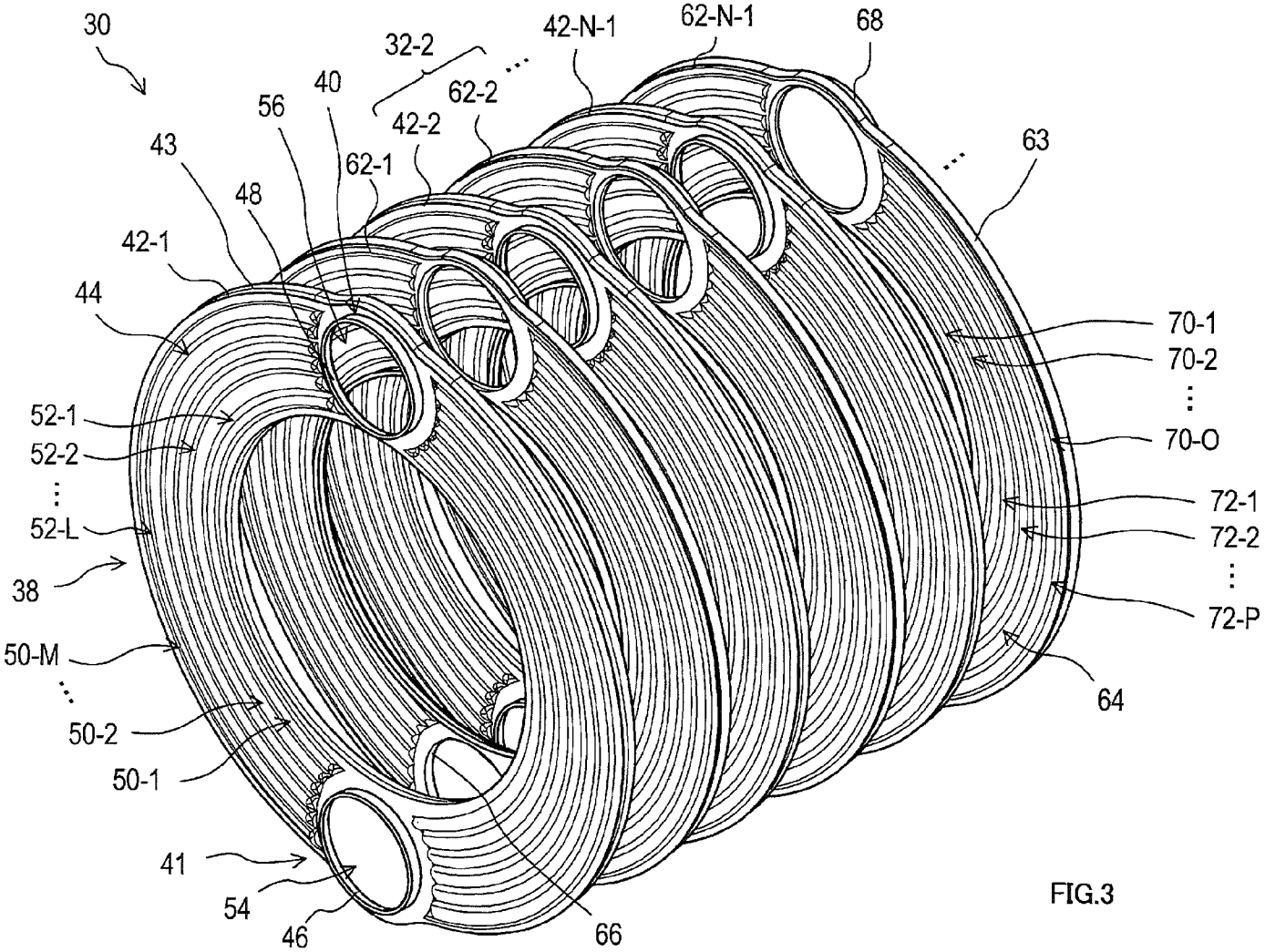
FIG. 3 is a perspective view showing a schematic configuration of a heat exchanger according to the embodiment.

Each of the plate parts 32 is a member comprising a flow channel for the cooling fluid 144 and, as shown in FIG. 3, comprises a body portion 38, a first communication portion 40, and a second communication portion 41. The body portion 38 comprises a general flow channel through which the first fluid flows inside the plate part 32. The first communication portion 40 and the second communication portion 41 serve as communication channels extending from the plate part 32 to other plate parts 32 adjacent to this plate part 32.

Specifically, each of the plate parts 32 comprises a first plate 42 and a second plate 62.

The first plate 42 is a member that, as a whole, has a ring-like (cylindrical) shape. Each of the first plates 42 comprises a wall part 43; the wall parts 43 project from respective peripheries of the first plates 42 in the same direction. Hereinafter, a surface of the first plate 42 from which the wall part 43 projects is referred to as an inner surface, and a surface that is a reverse side of the surface from which the wall part 43 projects is referred to as an outer surface.

Moreover, the first plate 42 comprises a first body section 44, a first communication section 46, and a second communication section 48. The first body section 44 comprises first convexes 50-1 to 50-M and first concaves 52-1 to 52-L, which are disposed alternately along a radial direction. Accordingly, each of the outer surface and the inner surface of the first plate 42 has a sine-wave shaped cross section taken along the radial direction.

The reference "M" used herein is an identifier indicating the number of the first convexes 50 and is a positive integer of 1 or greater. The reference "L" used herein is an identifier indicating the number of the first concaves 52 and is a positive integer of 1 or greater.

Each of the first convexes 50 is a portion of an outer surface of the first body section 44, which protrudes in a linear ridge-like manner from the outer surface of the first body section 44 toward a direction opposite to the projection direction of the wall part 43. Such linear ridge-like portions in each of the first convexes 50 are arranged along a circumferential direction of the first body section 44.

The first concave 52 is a portion of an inner surface of the first body section 44, which protrudes in a linear ridge-like manner from the inner surface of the first body section 44 toward the projection direction of the wall part 43. Such linear ridge-like portions in each of the first concaves 52 are arranged adjacent to the first convexes 50 along the circumferential direction of the first body section 44.

The second plate 62 is a ring-like (cylindrical) member. Each of the second plates 62 comprises a wall part 63; the wall parts 63 project from respective peripheries of the second plates 62 in the same direction. Hereinafter, a surface of the second plate 62 from which the wall part 63 projects is referred to as an inner surface, and a surface that is a reverse side of the surface from which the wall part 63 projects is referred to as an outer surface.

Moreover, the second plate 62 comprises a second body section 64, a third communication section 66, and a fourth communication section 68. The second body section 64 comprises second convexes 70-1 to 70-O and second concaves 72-1 to 72-P, which are disposed alternately along a radial direction. Accordingly, the second plate 62 is formed such that each of the outer surface and the inner surface of the second plate 62 has a sine-wave shaped cross section along the radial direction.

The reference "O" used herein is an identifier indicating the number of the second convexes 70 and is a positive integer of 1 or greater. The reference "P" used herein is an identifier indicating the number of the second concaves 72 and is a positive integer of 1 or greater.

The second convex 70 is a portion of an outer surface of the second body section 64, which protrudes in a linear ridge-like manner from the outer surface of the second body section 64 toward a direction opposite to the projection direction of the wall part 63. Such linear ridge-like portions in each of the second convexes 70 are arranged along a circumferential direction of the second body section 64.

The second concave 72 is a portion of an inner surface of the second body section 64, which protrudes in a linear ridge-like manner from the inner surface of the second body section 64 toward the projection direction of the wall part 63. Such linear ridge-like portions in each of the second concaves 72 are arranged adjacent to the second convex 70 along the circumferential direction of the second body section 64.

It is to be noted that the first body section 44 and the second body section 64, each of which has the inner surface and the outer surface formed in a corrugated shape, correspond to one example of a corrugated part of the present disclosure.

Each of the plate parts 32 is formed by engaging an inner surface of the wall part 43 of the first plate 42 with an outer surface of the wall part 63 of the second plate 62. In each of the plate parts 32, the first plate 42 and the second plate 62 are arranged such that the inner surface of the first plate 42 and the inner surface of the second plate 62 are not in contact with each other.

In addition, in each of the plate parts 32, the first plate 42 and the second plate 62 are arranged such that an apex of the first concave 52 and an apex of the second concave 72 are alternately located. The term "alternately" used herein means that the apex of the first concave 52 and the apex of the second concave 72 do not coincide with each other in an axial direction. In the present embodiment, a specific example of "alternately" includes a configuration in which the apex of the second concave 72 of the second plate 62 coincides with an apex of the first convex 50 of the first plate 42 in the axial direction.

With this configuration, each of the plate parts 32 has a gap between the inner surface of the first plate 42 and the inner surface of the second plate 62, which together forms one plate part 32. This gap serves as a flow channel for the cooling fluid 144, i.e., the general channel. The first body section 44 and the second body section 64 having the gap therebetween serve as the body portion 38.

The plate parts 32 are arranged in a non-contact state where a gap 82 (see FIG. 2) exists between respective outer surfaces of mutually-adjacent plate parts 32. Moreover, each of the plate parts 32 is arranged such that the apex of the first convex 50 and the apex of the second convex 70, which protrude from respective mutually-facing outer surfaces of the mutually-adjacent plate parts 32, are alternately located.

The term "alternately" used herein means that the apex of the first convex 50 of the first plate 42 and the apex of the second convex 70 of the second plate 62 having the outer surface facing the outer surface of this first plate 42 do not face to each other in the arrangement direction (i.e., axial direction) of the plate parts 32. In the present embodiment, a specific example of "do not face" includes a configuration in which the apex of the first convex 50 of the first plate 42 coincides, in the axial direction, with the apex of the second concave 72 of the second plate 62 having the outer surface facing the outer surface of this first plate 42.

The third communication section 66 of the second plate 62 is joined with the first communication section 46 of the first plate 42 that has the outer surface facing the outer surface of this second plate 62, thereby forming the second communication portion 41. This second communication portion 41 comprises a flow channel, through which the cooling fluid 144 from the inlet pipe 34 flows to an inside of the plate part 32 comprising the first plate 42. That is, a first communication hole 54 of the first plate 42 serves as an inlet for the cooling fluid 144 to this plate part 32.

Also, the second communication section 48 of the first plate 42 is joined with the fourth communication section 68 of the second plate 62 that has the outer surface facing the outer surface of this first plate 42, thereby forming the first communication portion 40. This first communication portion 40 comprises a communication channel, through which the cooling fluid 144 from the inside of the plate part 32 comprising the first plate 42 flows to the outlet pipe 36. That is, a second communication hole 56 of the first plate 42 serves as an outlet for the cooling fluid 144 from this plate part 32.

Referring back to FIG. 2, the heat exchanger 30 is disposed such that a gap 80 is formed between inner circumferential peripheries of the plate parts 32 and an outer surface of the exhaust pipe 12. The heat exchanger 30 is disposed such that a gap 84 is formed between radially outer peripheries of the plate parts 32 and an inner surface of the outer shell member 20.

With this configuration, in the heat exchanger 30 of the present embodiment, the exhaust gas 142 flows through the gap 80, the gap 82, and the gap 84. This flow direction of the exhaust gas 142 is a direction along a radial direction of the heat exchanger 30. Accordingly, in the heat exchanger 30 of the present embodiment, respective longitudinal directions of the first convex 50 and the second convex 70 in the plate part 32 are orthogonal to the flow direction of the exhaust gas 142.

Moreover, in the heat exchanger 30, heat is exchanged between the exhaust gas 142 as a high temperature fluid, which flows through the gap 80, the gap 82, and the gap 84, and the cooling fluid 144 as a low temperature fluid, which flows inside each of the plate parts 32. That is, the heat exchange chamber 28 in which the heat exchanger 30 is disposed serves as the heat exchange part 6.

The holding member 24 holds the heat exchanger 30 disposed in the heat exchange chamber 28.

An introduction member 88 to be coupled to the holding member 24 is a cylindrical member having a diameter larger than the outer diameter of the exhaust pipe 12; one end of the introduction member 88 is coupled to the holding member 24.

In the introduction member 88, an end thereof opposite to the end coupled to the holding member 24 is formed in the shape of a diffuser having an expanding diameter.

The introduction member 88 is disposed such that a circumferential clearance is formed between the introduction member 88 and the exhaust downstream end 18 of the exhaust pipe 12. This clearance serves as an inlet, through which the exhaust gas 142 flows from the exhaust part 2 to the heat exchange part 6, in other words, serves as the inflow part 8.

The valve 10 at least comprises a valve element 94 and a valve seat 96; the valve 10 closes the exhaust part 2 (i.e., the introduction member 88) when the valve element 94 is brought into contact with the valve seat 96.

In the present embodiment, the diffuser-shaped end of the introduction member 88 serves as the valve seat 96. It is to be noted that the valve seat 96 of the present disclosure is not limited to this configuration, and may be configured as a part exclusively for the valve seat 96.

Attached to the valve seat 96 is a mesh member 100. The mesh member 100 is a member having a mesh structure.

The valve 10 in the present embodiment is made to open when a temperature of the cooling fluid 144 of the internal combustion engine 140 is above a specified temperature that is pre-specified. On the other hand, the valve 10 is made to be closed when the temperature of the cooling fluid 144 of the internal combustion engine 140 is below the specified temperature.

<Effects of Embodiments>

Because the plate parts 32 of the heat exchanger 30 are arranged in the non-contact state with respect to one another, the gap 82 is formed between the respective outer surfaces of the mutually-adjacent plate parts 32. In addition, the apex of the first convex 50 and the apex of the second convex 70, which protrude from the respective mutually-facing outer surfaces of the mutually-adjacent plate parts 32, are alternately arranged; therefore, the gap 82 formed between the plate parts 32 has a corrugated gap.

Moreover, the exhaust gas 142 flows, through the corrugated gap 82, in a direction orthogonal to the respective longitudinal directions of the first convex 50 and the second convex 70. Accordingly, part of the exhaust gas 142 flowing in the gap 82 hits the first convex 50 and the second convex 70. For this reason, the heat exchanger 30 can inhibit formation of a boundary layer around the first convex 50 and the second convex 70 to which the part of the exhaust gas 142 hits, thereby increasing heat transfer efficiency between the outer surfaces of the plates and the second fluid.

Furthermore, in the heat exchanger 30, the corrugated gap 82 serves as the flow path for the exhaust gas 142. Thus, blocking of the flow of the exhaust gas 142 can be inhibited as much as possible, and occurrence of decrease in a flow rate of the exhaust gas 142 can be reduced.

In addition, in the heat exchanger 30, the outer surface of the plate part 32 has a corrugated shape. For this reason, with the heat exchanger 30, an increased surface area of the plate part 32, which contacts with the exhaust gas 142, can be obtained.

Moreover, in the heat exchanger 30, not only the outer surface of the plate part 32, but also the inner surface of the plate part 32 has a corrugated shape. For this reason, with the heat exchanger 30, an increased surface area of the plate part 32, which contacts with the cooling fluid 144, can be obtained.

The cooling fluid 144 inside the heat exchanger 30 flows along respective longitudinal directions of the first concave 52 and the second concave 72. For this reason, the heat exchanger 30 can reduce resistance to the flow of the cooling fluid 144, i.e., pressure loss, as much as possible.

As has been described above, the heat exchanger 30 can further improve the heat exchange efficiency.

Moreover, the heat exchanger 30 as a whole has a cylindrical shape, and the exhaust gas 142 flows along the radial direction. Thus, in the heat exchanger 30, the flow direction of the exhaust gas 142 can be made to be a direction orthogonal to a flow direction of the cooling fluid 144. In addition, with the heat exchanger 30, this configuration in which the flow direction of the exhaust gas 142 is the direction orthogonal to the flow direction of the cooling fluid 144 can be achieved along the entire radial direction of the plate parts 32.

[Other Embodiments]

The embodiment of the present disclosure has been described above. However, the present disclosure is not limited to the above-described embodiment and can be carried out in various modes without departing from the scope of the present disclosure.

For example, although in the above-described embodiment, an object to which the heat exchanger 30 is applied is the exhaust-gas heat recovery device 1, the object to which the heat exchanger 30 is applied is not limited to the exhaust-gas heat recovery device 1.

Figure 4:
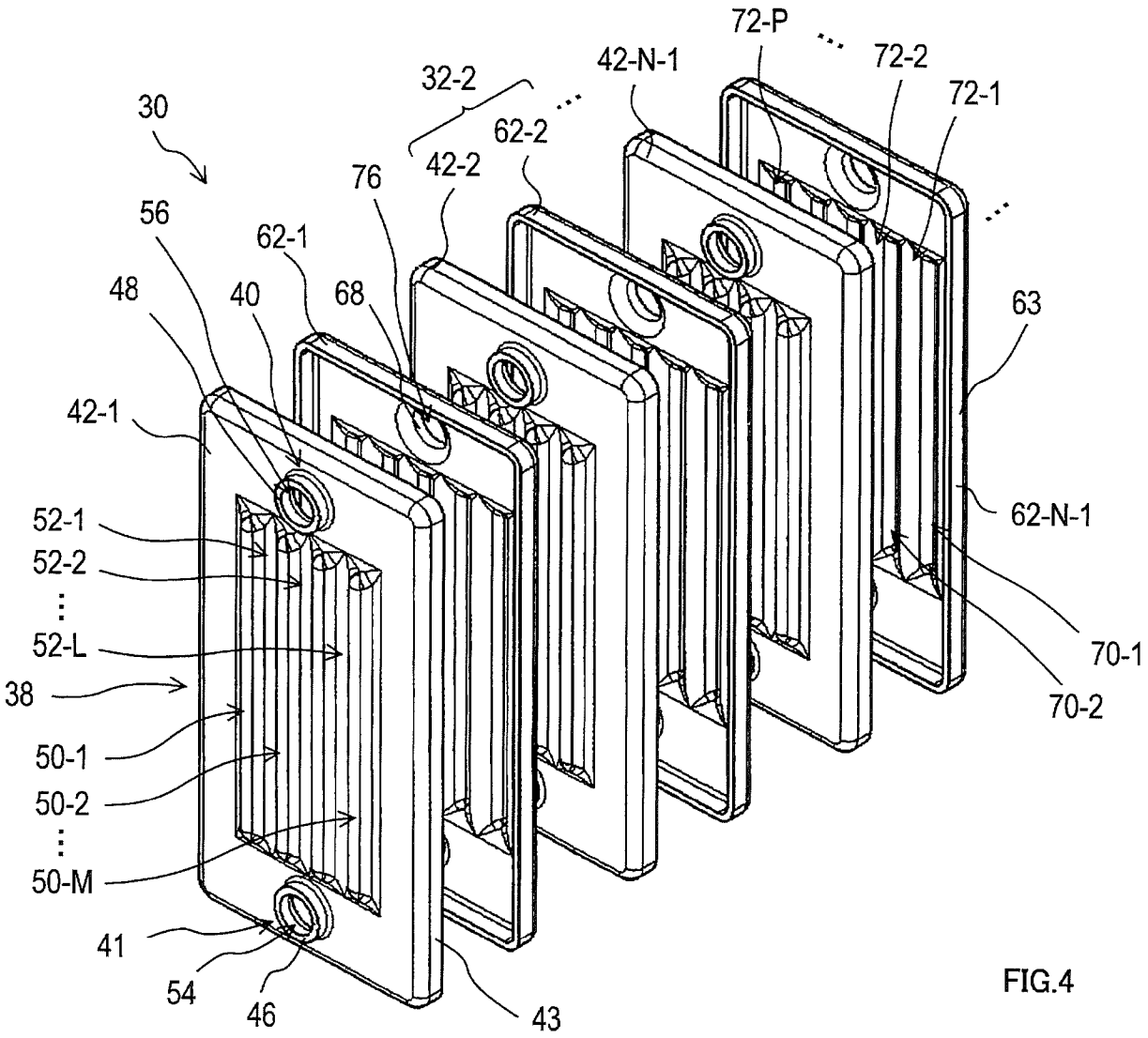
FIG. 4 is a perspective view showing a schematic configuration of a heat exchanger according to a modified example.

Moreover, the shape of the plate part 32 in the heat exchanger 30 is not limited to the cylindrical shape. Specifically, in the heat exchanger of the present disclosure, the plate part 32 may have a rectangular shape as shown in FIG. 4, or other shapes.

When the plate part 32 has a rectangular shape, for example, the linear ridge-like portions of the first convexes 50 and the linear ridge-like portions of the first concaves 52 may extend along a longitudinal direction of the first plate 42. Also, the linear ridge-like portions of the second convexes 70 and the linear ridge-like portions of the second concaves 72 may extend along a longitudinal direction of the second plate 62.

That is, when the plate part 32 has the rectangular shape, the first convexes 50 and the first concaves 52 are arranged alternately along a short-side direction of the first plate 42, so that each of an outer surface and an inner surface of the first plate 42 may have a corrugated shape in a cross section taken along the short-side direction of the first plate 42. Also, when the plate part 32 has the rectangular shape, the second convexes 70 and the second concaves 72 are arranged alternately along a short-side direction of the second plate 62, so that each of an outer surface and an inner surface of the second plate 62 may have a corrugated shape in a cross section taken along the short-side direction of the second plate 62.

Moreover, in the heat exchanger 30 of the above-described embodiment, the surface of the plate part 32 has a sine-wave shape along the radial direction. However, the surface of the plate part 32 is not limited to this shape, and may have a triangular corrugated shape, a rectangular corrugated shape, or a saw-tooth corrugated shape. That is, the surface of the plate part 32 may have any corrugated shape.

Furthermore, in the above-described embodiment, the plate part 32 is configured with the first plate 42 and the second plate 62, which are formed separately from each other. However, the plate part 32 may be configured with the first plate 42 and the second plate 62, which are formed integrally.

In the above-described embodiment, the clearance formed between the exhaust downstream end 18 and the introduction member 88 serves as the inlet for the exhaust gas 142 flowing from the exhaust pipe 12 to the heat exchange part 6. However, the inlet for the exhaust gas 142 flowing from the exhaust pipe 12 to the heat exchange part 6 may be provided in the exhaust pipe 12 by providing a bore in the exhaust pipe 12 itself.

It is to be noted that a mode in which part of the configuration in the above-described embodiment is omitted is included in the embodiment of the present disclosure. Also, a mode configured by appropriately combining the above-described embodiment with modified examples is included in the embodiment of the present disclosure. In addition, any modes that can be conceived without departing from the spirit of the disclosure defined in the claims are included in the embodiment of the present disclosure.

The invention claimed is:

1. A heat exchanger comprising:

a plurality of plate pairs comprising a flow channel through which a first fluid flows, wherein each of the plurality of plate pairs comprises a corrugated part, the corrugated part comprising at least one convex protruding in a linear ridge-like manner outwardly from an outer surface of each of the plurality of plate pairs at a specified distance, and the outer surface has a corrugated shape, wherein the plurality of plate pairs is arranged such that: (i) a longitudinal direction of the at least one convex is a direction orthogonal to a flow direction of a second fluid; (ii) respective outer surfaces of mutually-adjacent plate pairs are in a non-contact state having a gap between the respective outer surfaces, and (iii) apexes, each of which is an apex of the at least one convex protruding from each of respective mutually-facing outer surfaces of the mutually-adjacent plate pairs, do not face each other in an arrangement direction of the plurality of plate pairs, wherein each plate pair of the plurality of plate pairs comprises a first plate and a second plate, and wherein, for each plate pair of the plurality of plate pairs, the first plate and the second plate are arranged such that an inner surface of the first plate and an inner surface of the second plate are not in contact with each other.

2. The heat exchanger according to claim 1, wherein the first plate in combination with the second plate is arranged to form a tubular shape, and wherein each plate pair of the plurality of plate pairs is arranged along an axial direction.

3. The heat exchanger according to claim 1, wherein the first plate comprises a wall part on a periphery of the first plate, the wall part of the first plate projecting in a direction perpendicular to the first plate, and wherein the second plate comprises a wall part on a periphery of the second plate, the wall part of the second plate projecting in a direction perpendicular to the second plate.

4. The heat exchanger according to claim 3, wherein an inner surface of the wall part of the first plate engages with an outer surface of the wall part of the second plate.

5. A heat exchanger comprising:

a plurality of plate pairs comprising a flow channel through which a first fluid flows, wherein each plate pair of the plurality of plate pairs comprises a corrugated part, the corrugated part comprising at least one convex protruding in a linear ridge-like manner outwardly from an outer surface of each plate pair of the plurality of plate pairs at a specified distance, and the outer surface has a corrugated shape, wherein the plurality of plate pairs is arranged such that: (i) a longitudinal direction of the at least one convex is a direction orthogonal to a flow direction of a second fluid; (ii) respective outer surfaces of mutually-adjacent plate pairs of the plurality of plate pairs are in a non-contact state having a gap between the respective outer surfaces; and (iii) apexes, each of which is an apex of the at least one convex protruding from each of respective mutually-facing outer surfaces of the mutually-adjacent plate pairs, do not face each other in an arrangement direction of the plurality of plate pairs, wherein the corrugated part of each plate pair comprises at least one concave, the at least one concave protruding inwardly in a linear ridge-like manner from an inner surface such that the at least one concave is adjacent to the at least one convex and that the outer surface is depressed from the at least one convex, and the inner surface has a corrugated shape, and wherein each plate pair of the plurality of plate pairs is configured such that: the inner surfaces that face each other are in a non-contact state having a gap between the inner surfaces; and a longitudinal direction of the at least one concave is a direction along a flow direction of the first fluid.

6. The heat exchanger according to claim 5, wherein each plate pair of the plurality of plate pairs comprises a first plate and a second plate that in combination are arranged to form a tubular shape, and wherein each plate pair of the plurality of plate pairs is arranged along an axial direction.

7. The heat exchanger according to claim 5, wherein each plate pair of the plurality of plate pairs comprises a first plate and a second plate, wherein the first plate comprises a wall part on a periphery of the first plate, the wall part of the first plate projecting in a direction perpendicular to the first plate, and wherein the second plate comprises a wall part on a periphery of the second plate, the wall part of the second plate projecting in a direction perpendicular to the second plate.

8. The heat exchanger according to claim 7, wherein an inner surface of the wall part of the first plate engages with an outer surface of the wall part of the second plate.

* * * * *